US011454447B2

(12) United States Patent
Makepeace et al.

(10) Patent No.: US 11,454,447 B2
(45) Date of Patent: Sep. 27, 2022

(54) STIRRING OF MOLTEN METALS

(71) Applicant: Altek Europe Ltd., Chesterfield (GB)

(72) Inventors: Stephen Makepeace, Chesterfield (GB); Alan Peel, Chesterfield (GB); Isaac Sewell, Chesterfield (GB)

(73) Assignee: ALTEK EUROPE LIMITED, Chesterfield (GB)

( * ) Notice: Subject to any disclaimer, the term of this patent is extended or adjusted under 35 U.S.C. 154(b) by 0 days.

(21) Appl. No.: 16/462,026

(22) PCT Filed: Nov. 27, 2017

(86) PCT No.: PCT/GB2017/053565
§ 371 (c)(1),
(2) Date: May 17, 2019

(87) PCT Pub. No.: WO2018/096368
PCT Pub. Date: May 31, 2018

(65) Prior Publication Data
US 2019/0301804 A1 Oct. 3, 2019

(30) Foreign Application Priority Data
Nov. 26, 2016 (GB) ..... 1620024

(51) Int. Cl.
*F27D 27/00* (2010.01)
*B01F 101/45* (2022.01)
(Continued)

(52) U.S. Cl.
CPC ..... *F27D 27/00* (2013.01); *B01F 33/451* (2022.01); *B01F 2101/45* (2022.01); *F27D 2003/0039* (2013.01)

(58) Field of Classification Search
CPC ..... B01F 13/0809; B01F 2215/075; F27D 2003/0039; F27D 27/00; B22D 11/115
See application file for complete search history.

(56) References Cited

U.S. PATENT DOCUMENTS 2,960,556 A * 11/1960 Fredriksson ..... H05B 6/34 336/215
3,200,185 A * 8/1965 Karlsson ..... F27D 27/00 373/146

(Continued)

FOREIGN PATENT DOCUMENTS

JP 59197363 A * 11/1984 ..... B22D 11/115
JP H07 270083 A 10/1995
JP H09 135563 A 5/1997

OTHER PUBLICATIONS

International Search Report and Written Opinion from counterpart International Patent Application No. PCT/GB2017/053565 dated Feb. 9, 2018, 13 pages.

*Primary Examiner* — Scott R Kastler
(74) *Attorney, Agent, or Firm* — Norton Rose Fulbright US LLP

(57) ABSTRACT

Apparatus and methods for stirring a molten metal are provided. The apparatus comprising: an electromagnetic stirrer, the electromagnetic stirrer including a core, the core being provided with two or more teeth, the core being provided with two or more electrically conducting coils; connections for applying a current to the electrically conducting coils; wherein the two or more teeth have an end proximal the core and an end distal the core, the end distal the core defining a tooth end face, the tooth end face for at least one of the teeth not being aligned with the tooth end face for at least one of the other teeth. In this way the air gap between the teeth and the container in which molten metal is to be stirrer can be kept small, even with curved walls or bases to the container.

17 Claims, 4 Drawing Sheets

(51) Int. Cl.
*B01F 33/451* (2022.01)
*F27D 3/00* (2006.01)

(56) References Cited

U.S. PATENT DOCUMENTS

| | | | | |
|---|---|---|---|---|
| 4,321,958 | A * | 3/1982 | Delassus | B22D 11/115 164/468 |
| 2010/0044934 | A1 | 2/2010 | Taniguchi et al. | |
| 2018/0029112 | A1* | 2/2018 | Muramatsu | B22D 11/115 |
| 2019/0301805 | A1* | 10/2019 | Makepeace | F27D 27/00 |

* cited by examiner

STIRRING OF MOLTEN METALS

CROSS-REFERENCE TO RELATED APPLICATIONS

This application is a national phase under 35 U.S.C. § 371 of International Application No. PCT/GB2017/053565, filed Nov. 27, 2017, which claims the benefit of priority to United Kingdom Patent Application No. 1620024.8, filed Nov. 26, 2916, the entire contents of each of which are hereby incorporated by reference in their entirety.

BACKGROUND OF THE INVENTION

The present invention concerns improvements in and relating to electromagnetic stirring of molten metals, particularly apparatus for stirring and methods of stirring.

It is known to use electromagnets to generate moving magnetic fields within molten metal and as a consequence generate motion within the molten metal. The movement causes stirring of the molten metal within its container, with beneficial effects on heat transfer, material dispersion and the like.

In general, planar electromagnetic stirrers are deployed close to a planar wall of the container in which the molten metal is to be stirrer.

Whilst planar walls for containers are commonplace, there are situations in which such planar walls are not present or are not readily accessible for deployment of an electromagnetic stirrer.

BRIEF SUMMARY OF THE INVENTION

The present invention has amongst its potential aims to provide apparatus for stirring and methods of stirring which are more optimised for deployment relative to non-planar walls of containers, particularly larger containers. The present invention has amongst its potential aims to provide apparatus for stirring and methods of stirring which provide better stirring effects within rotary furnaces or other containers with a curved profile to one or more walls of the container. The present invention has amongst its potential aims to provide apparatus for stirring and methods of stirring which provides a stronger magnetic field and/or optimised magnetic field configuration within molten metal.

DETAILED DESCRIPTION OF THE INVENTION

According to a first aspect of the invention there is provided apparatus for stirring a molten metal, the apparatus comprising:

an electromagnetic stirrer, the electromagnetic stirrer including a core, the core being provided with two or more teeth, the core being provided with two or more electrically conducting coils;

connections for applying a current to the electrically conducting coils;

wherein the two or more teeth have an end proximal the core and an end distal the core, the end distal the core defining a tooth end face, the tooth end face for at least one of the teeth not being aligned with the tooth end face for at least one of the other teeth.

According to a second aspect of the invention there is provided a method of manufacturing apparatus for stirring a molten metal, the method comprising:

measurement of the non-planar characteristics of the wall for the container for the molten metal at the location at which stirring is to be provided;

providing an electromagnetic stirrer, the electromagnetic stirrer including a core, the core being provided with two or more teeth, the core being provided with two or more electrically conducting coils;

providing connections for applying a current to the electrically conducting coils;

wherein the two or more teeth have an end proximal the core and an end distal the core, the end distal the core defining a tooth end face, the tooth end face for at least one of the teeth not being aligned with the tooth end face for at least one of the other teeth; and wherein the extent of non-alignment of the tooth end faces is determined from the measurement of the non-planar characteristics of the wall.

According to a third aspect of the invention there is provided a method of stirring molten metal within a container, the method including:

providing an electromagnetic stirrer, the electromagnetic stirrer including a core, the core being provided with two or more teeth, the core being provided with two or more electrically conducting coils;

applying a current to at least one of the electrically conducting coils at a first time to generate a first magnetic field configuration;

applying a current to at least one of the other electrically conducting coils at a second time to generate a second magnetic field configuration, such that the changes in magnetic field configuration cause movement of the molten metal within the container;

wherein the two or more teeth have an end proximal the core and an end distal the core, the end distal the core defining a tooth end face with a tooth edge around that tooth end face, a tooth end face plane being defined as the plane passing through three points on the tooth edge of the tooth end face, the tooth end face plane for at least one of the teeth not being aligned with the tooth end face plane for at least one of the other teeth.

The first, second and third aspects of the invention may include any of the following features, options and possibilities.

The core may include a base connector upon which one or more or all of the teeth are provided. The core may include a base connector which connects one or more of the teeth together. The core may provide a magnetic circuit between one tooth and one or more other teeth. The base connector may have a face from which the one or more teeth extend. The base connector may have a face opposing the face from which the teeth extend. One or both faces may be planar.

The tooth end face for at least one of the teeth may be considered not aligned with the tooth end face for at least one of the other teeth when one or more or all of the following apply:

1) One or more tooth end faces are inclined at an angle relative to one or more another tooth end faces;
2) One or more tooth end faces are inclined at an angle relative to a face of the base connector which connects two or more of the teeth together;
3) One or more tooth end faces are inclined at an angle relative to one or more another tooth end faces and one or more tooth end faces are parallel to a face of the base connector which connects two or more of the teeth together;
4) One or more tooth end faces are parallel to, but not coplanar with one or more another tooth end faces;

5) One or more tooth faces are parallel to, but not coplanar with one or more another tooth end faces and are parallel to, but not coplanar with a face of the base connector.

One or more or each of the tooth end faces may have a tooth edge around that tooth end face. The tooth edge may be defined by the boundary between the tooth end face and the side surface or surfaces of the tooth. A tooth end face plane may be defined for one or more of the tooth end faces. The tooth end plane may be defined as a plane passing through three points on the tooth edge of the tooth end face.

The tooth end face for at least one of the teeth may be considered not aligned with the tooth end face for at least one of the other teeth when the tooth end face plane for at least one of the teeth is not aligned with the tooth end face place for at least one of the other teeth. The tooth end faces may be considered not to be aligned when one or more or all of the following apply:

1) One or more tooth end face planes are inclined at an angle relative to one or more another tooth end face planes;
2) One or more tooth end face planes are inclined at an angle relative to a face of the base connector which connects two or more of the teeth together;
3) One or more tooth end face planes are inclined at an angle relative to one or more another tooth end face planes and one or more tooth end faces are parallel to a face of the base connector which connects two or more of the teeth together;
4) One or more tooth end face planes are parallel to, but not coplanar with one or more another tooth end face planes;
5) One or more tooth end face planes are parallel to, but not coplanar with one or more another tooth end face planes and are parallel to, but not coplanar with a face of the base connector;
6) One or more of the tooth end faces is non-planar, but one or more of criteria 1 to 5 in this list apply.

One or more or all of the teeth may extend perpendicular to the base connection. Each tooth may have an extent away from the base connection. One or more of the teeth may have a greater extent that one or more of the other teeth. The tooth end face or a part thereof may represent the maximum extent of the tooth away from the base connection.

The outermost tooth on one side of the set of teeth, preferably the outermost tooth on both sides of the set of teeth, may be have a greater extent and/or be longer than one or more and preferably all of the other teeth. Preferably the extent and/or length of the outermost teeth is the same. The inner most tooth for an odd number of teeth and the innermost pair of teeth for an even number of teeth may have a lesser extent and/or be shorter than one or more or preferably all of the other teeth.

Teeth intermediate the outermost and the innermost teeth or pair of teeth may have an intermediate extent and/or length.

Where four teeth are provided, then outermost tooth on both sides of the set of teeth may have a greater extent and/or be longer than one or both inner teeth. Preferably the extent and/or length of the outermost teeth is the same. The inner pair of teeth may have a lesser extent and/or be shorter than one or both outer teeth. Preferably the extent and/or length of the innermost pair of teeth is the same.

Where three teeth are provided, then outermost tooth on both sides of the set of teeth may have a greater extent and/or be longer than innermost tooth. Preferably the extent and/or length of the outermost teeth is the same. The innermost tooth may have a lesser extent and/or be shorter than one or both outer teeth.

Where two teeth are provided preferably the outermost portion of the tooth end face has a greater extent and/or is longer than one or more and preferably all of the other portions of the tooth end face, particularly the innermost portion of the tooth end face. The innermost portion of the tooth end face may have a lesser extent and/or be shorter than one or more or preferably all of the other portions of the tooth end face.

One or more or all of the tooth end faces may be provided such that the air gap between the end face and the outer wall of the opposing part of the container for the molten metal is less than 10 cm, preferably less than 5 cm, more preferably less than 4 cm, still more preferably less than 3 cm, yet more preferably less than 2 cm and ideally less than 1 cm. One or more of the tooth end faces may be inclined and/or orientated and/or profiled so as to provide all of the tooth end face within a maximum air gap value. The maximum air gap value may be less than 10 cm, preferably less than 5 cm, more preferably less than 4 cm, still more preferably less than 3 cm, yet more preferably less than 2 cm and ideally less than 1 cm.

One or more or all of the tooth end faces may be aligned with the opposing part of the container for the molten metal. A tooth end face may be so aligned when one or more or all of the following apply:

a) A location on the tooth end face for two or more and preferably all tooth end faces lies on a common arc;
b) A location on the tooth end face for two or more and preferably all tooth end faces lies on a common arc and that common arc is concentric with the arc defined by at least the opposing part of the container for the molten metal;
c) An equivalent location on the tooth end face for two or more and preferably all tooth end faces lies on a common arc;
d) An equivalent location on the tooth end face for two or more and preferably all tooth end faces lies on a common arc and that common arc is concentric with the arc defined by at least the opposing part of the container for the molten metal;
e) The centre of the tooth end face for two or more and preferably all tooth end faces lies on a common arc;
f) The centre of the tooth end face for two or more and preferably all tooth end faces lies on a common arc and that common arc is concentric with the arc defined by at least the opposing part of the container for the molten metal.

The opposing part of the container may preferably be a metal plate, such as a stainless steel plate.

The opposing part of the container may be a side wall for the container, for instance with the apparatus to the side of the container.

The opposing part of the container may be a base of the container, for instance with the apparatus under the container.

The casing for the apparatus may pass through the air gap between the tooth end faces and the opposing part of the container.

The casing for the apparatus may be a metal skin or barrier to protect the apparatus from factors in the environment such as molten metal or metal.

The casing may include a container opposition section. The container opposing section of the casing may pass through the air gap between the tooth end faces and the opposing part of the container. The container opposing section may be profiled to provide a consistent separation between the section and the opposing part of the container. The consistent separation may be provided if the separation varies by less than 2 cm, more preferably less than cm across different parts of the container opposing section. The container opposing section may be profiled to provide a consistent maximum separation between the section and the closest part of the tooth end faces. The consistent separation may be provided if the separation varies by less than 2 cm, more preferably less than 1 cm, ideally less than 0.5 cm across different parts of the container opposing section.

The apparatus may have an extent relative to the container, particularly an opposing part of the container. The extent may be an arc extent. The extent may be less than 20% of the perimeter of the container, preferably less than 15% of the perimeter and more preferably less than 10% of the perimeter and potentially less than 5% of the perimeter.

The measurement of the non-planar characteristics of the wall for the container for the molten metal at the location at which stirring is to be provided may be made with reference to the opposing part of the container to the apparatus and/or may include one or more of: the curvature of the wall; the variation in radial extent of the wall; the shape of the profile, for instance arc, within that part of the wall.

The first, second and third aspects of the invention may include any of the following features, options and possibilities, together with those set out in the specific description and elsewhere within the application.

The method of stirring may be a method of stirring molten metal. The method of stirring may be a method of stirring aluminium.

The method of stirring may be a method of stirring a furnace. The method of stirring may be a method of stirring a ladle, storage vessel, transport vessel, holding furnace.

The method of stirring may be a method of stirring using a side mounted stirrer.

A apparatus may further include one or more of: a casing for the apparatus; a support frame; one or more cooling spaces; a control system. The support frame may support the core and/or one or more or all of the coils of electrical conductor and/or the control system.

The support frame may support the core and/or teeth and/or electrically conducting coils and/or casing for the apparatus and/or cooling system and/or control system. The support frame preferably maintains a consistent position for the support the core and/or teeth and/or electrically conducting coils and/or casing for the apparatus during the application of and removal of current to one or more or all of the electrically conducting coils.

The one or more cooling spaces may be provided within the apparatus and be in fluid communication with a source of coolant.

The control system may control the current and/or voltage and/or timing thereof and/or duration thereof for one or more and preferably all of the electrically conductive coils. The control system may control the phases and/or phasing of activation and/or deactivation of the magnetic field and/or current to the electrically conductive coils. The control system may apply a current to at least one of the electrically conducting coils at a first time to generate a first magnetic field configuration and/or applying a current to at least one of the other electrically conducting coils at a second time to generate a second magnetic field configuration, such that the changes in magnetic field configuration cause movement of the molten metal within the container.

The core is preferably formed of a ferromagnetic material, such as iron or steel. The core preferably integrally provides the connection base and the teeth extending therefrom.

The connections preferably provide for the separate application of current to the separate electrically conducting coils. The connections preferably allow a single power supply to provide the current to the separate electrically conducting coils.

Various embodiments of the invention will not be described, with reference to the accompanying drawings by way of example only, in which.

Figure 7A:
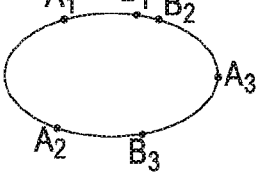
Figure 7B:
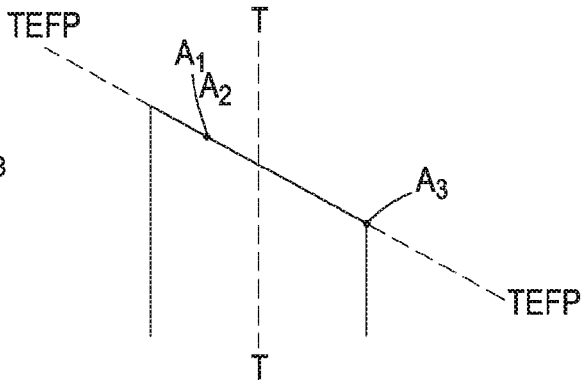
Figure 8:
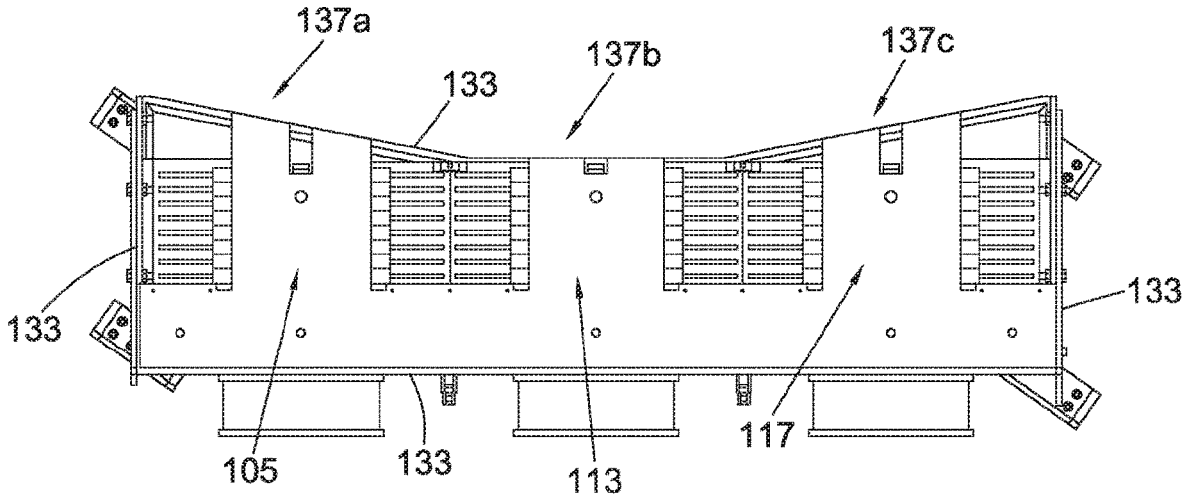

FIG. 7*a* illustrates a plan view of a tooth and FIG. 7*b* illustrates a side view of the same tooth with reference to the definition of a tooth end face plane;

FIG. 8 illustrates a plan view of an embodiment of the invention.

Figure 1:
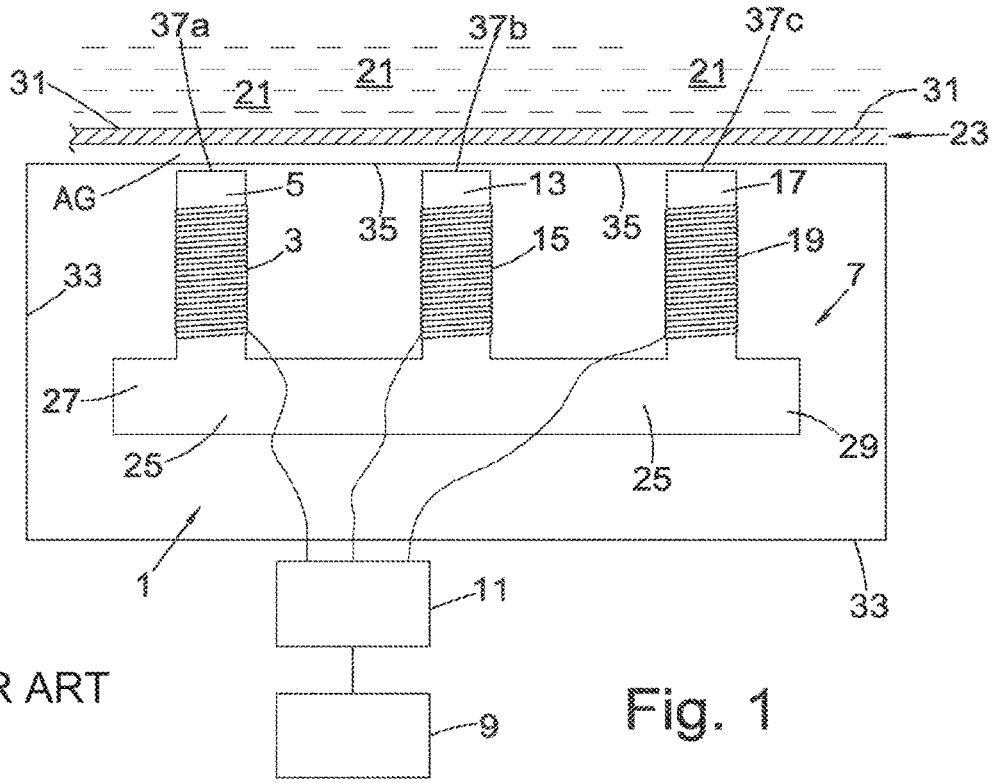
PRIOR ART Fig. 1
FIG. 1 illustrates a prior art planar electromagnetic stirrer configuration.

As illustrated in FIG. 1, an electromagnetic stirrer 1 comprises a closely coiled electrical conductor 3 wrapped around a first tooth 5 of a core 7. In such an arrangement the tooth can be considered as a pole and the terms can be used interchangeably. The conductor 3 is connected to a power supply 9 via a control system 11. The control system 11 determines the timing, current, voltage and other operating conditions applied to the electrical conductor 3 and hence the resultant magnetic field generated by the electrical conductor 3.

The core 7 is generally of a ferromagnetic or ferromagnetic material, such as iron, and is crucial to concentrating the magnetic flux and hence the generation of a more powerful magnetic field than would be achieved without the core 7. Typically a thousand time increase in the strength of the magnetic field is possible through the use of the core 7.

The magnetic field arises which a current passes through the conductor 3 and disappears when the current is removed. This occurs quickly and so makes the use of electromagnets beneficial where a changing magnetic field is required.

As shown in FIG. 1, the second tooth 13 has a second coil 15 and the third tooth 17 has a third coil 19. The control system 11 ensures that current can be fed to the first coil 7, second coil 15 and third coil 19 at different times. The use of different phases means that the configuration of the overall magnetic field arising changes with time. Correct configuration of the operating conditions, including the phase for the coils, ensures that the resultant magnetic field serves to move molten metal 21 (for instance aluminium) within the container 23 which the electromagnetic stirrer 1 is provided for.

In the FIG. 1 embodiment, the core 7 forms a continuous mass throughout the first tooth 5, second tooth 15, third tooth 17 and the connecting base 25. The connecting base 25 links the three poles and also provides a first side extension 27 and a second side extension 29 at the two ends. As a result, the first tooth 5, second tooth 15 and third tooth 17 are effectively individual teeth extending from the connecting base 25.

In effect, the core 7 and the molten metal 21 form a magnetic circuit with relatively low reluctance. The air gap AG has a higher reluctance but is kept small by the relative deployment of the electromagnetic stirrer 1 and the container 23.

As shown, the electromagnetic stirrer 1 is provided in proximity with a planar wall 31 of the container 23. The casing 33 provided around the electromagnetic stirrer 1 has a planar wall 35 facing the planar wall 33 of the container 23. The end faces 37*a*, 37*b* and 37*c* of the three poles are also aligned in a common plane (extending left to right in the illustration) and the connecting base 25 of the core 7 also means that the connecting base 25 and the ends 35*a*, 35*b* and 35*c* of the three poles distal to the planar wall 35 also occupy a separate common plane (extending left to right in the illustration).

In very many cases, the container 23 in which molten metal 21 is to be stirred features a planar wall 31, for instance as a side wall or a base wall, for the container 23 and so the planar wall 35 of the casing 33 can be placed close to the planar wall 31 of the container. This means that the total air gap AG is kept low.

Figure 2:
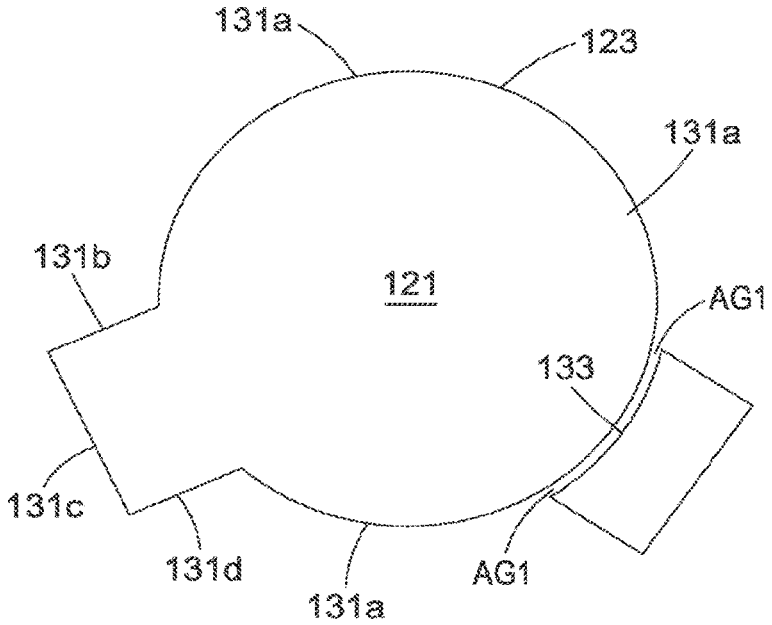
FIG. 2 illustrates in plan view a first embodiment of the present invention deployed relative to a rotary furnace.

As illustrated in FIG. 2, there are containers 123 which contain molten metal 121 and which require stirring, but which feature curved walls. In the FIG. 2 embodiment, the container 123 is a circular furnace and as such has a substantial diameter, for instance greater than 4 m, and hence a substantial circumference. The overall mass and/or size of the circumference means that furnace is not moveable and that a stirrer cannot encircle the container. Curved surfaces are also encountered in rotary furnaces and other such containers for molten metal.

As shown in FIG. 2, the major portion of the side wall 131*a* is curved. The limited planar walls 131*b*, 131*c*, 131*d*, are not suitable locations at which to provide stirring of the molten metal 121 within the container 123. As a consequence, any attempt to use a planar wall 35 style casing 33 for a an electromagnetic stirrer 1 of the type illustrated in FIG. 1 will result in a very large airgap AP, particularly at the location of the first tooth 5 and the third tooth 17 relative to the container 123.

In the embodiment of the invention illustrated in FIG. 2, a number of modifications to the electromagnetic stirrer 101 have been made.

The profile of the casing 133 is modified to be generally concentric with the perimeter wall 131*a* of the container 123. As a consequence, the air gap $AG_1$ between the outside of the perimeter wall 131*a* and the outside of the casing 133 is kept similar and low for all three poles.

Figure 3:
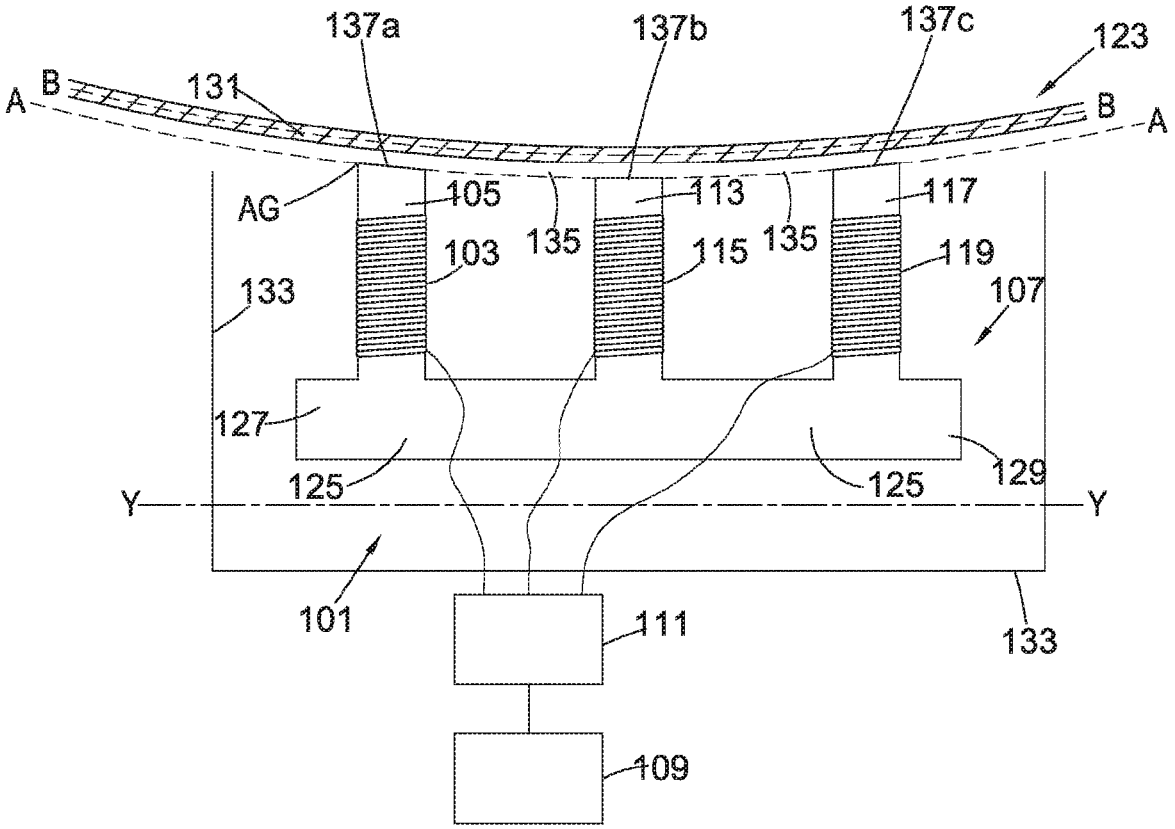
FIG. 3 illustrates the electromagnetic stirrer configuration for the embodiment of FIG. 2 in more detail.

As seen in the detailed view of FIG. 3, furthermore, the end face 137*a* for the first tooth 105, end face 137*b* for the second tooth 113 and end face 137*c* for the third tooth 117 are arranged such that the end faces lie on a common arc A-A which is concentric to the common arc B-B followed by the perimeter wall 131 of the container 123. The common arc A-A is not parallel to the planar connecting base 125 of the core 107, plane Y-Y. The casing 133 has been omitted for clarity, but also follows an arcuate profile concentric to both the common arc A-A and common arc B-B.

Figure 4:
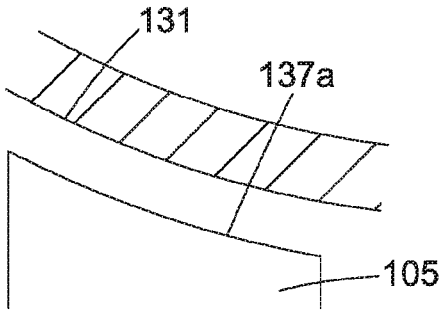
FIG. 4 illustrates a detailed view of the end configuration of one of the poles of the electromagnet of FIGS. 2 and 3.

As shown in FIG. 3, the end face 137*b* of the second tooth 113 is parallel to the planar connecting base 125 of the core 107, plane Y-Y. However, the end face 137*a* of the first tooth 105 is inclined relative to the planar connecting base 125 of the core 107, plane Y-Y, in a first direction. The end face 137*c* of the third tooth 117 is also inclined relative to the planar connecting base 125 of the core 107, plane Y-Y, in a second opposing direction. In this embodiment, as shown in FIG. 4, the end faces 137*a*, 137*b*, 137*c* are each arcuate in their own right, as shown for the first end face 137*a* and so the end face 137*a* fully follows the opposing curved wall 131 of the container (curve emphasised in FIG. 4).

Other non-planar arrangements for the combination of the end faces 137*a*, 137*b*, 137*c* of the first tooth 105, second tooth 113 and third tooth 117 are possible.

Figure 5:
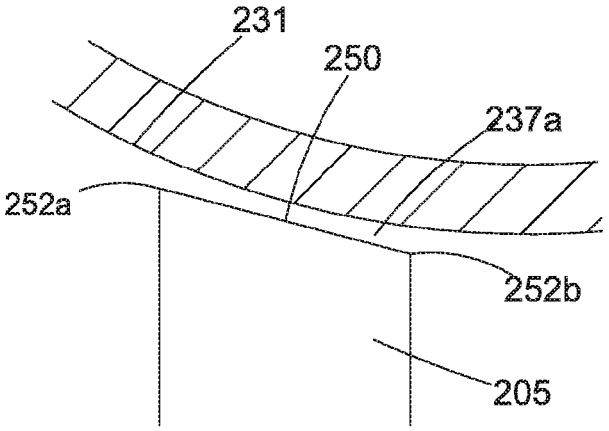
FIG. 5 illustrates a detailed view of the end configuration of one of the poles of the electromagnet according to a second embodiment of the invention.

As shown in FIG. 5, in relation to just the end face 237*a* of the first tooth 205, the centre-point 250 lies precisely on the arc A-A. The individual end faces 237*a*, 237*b*, 237*c*, as shown for the first end face 237*a* are planar and not arcuate. As such, the air gap varies very slightly from a lowest value at the centre-point 250 to slightly higher values at the edges 252*a*, 252*b* of the first end face 237*a*.

Figure 6:
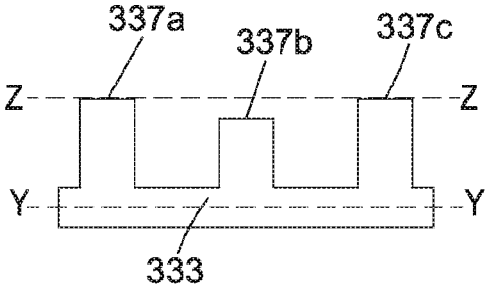
FIG. 6 illustrates schematically an electromagnetic stirrer configuration according to a third embodiment of the invention.

As shown in FIG. 6, each of the end faces 337*a*, 337*b*, 337*c* are parallel to the planar connecting base 333 of the core 307, plane Y-Y, and to each other. However, the end faces 337*a*, 337*b*, 337*c* are not coplanar with each other. The first end face 337*a* and the third end face 337*c* are coplanar, but the second end face 337*b* is offset relative to that plane Z-Z. The offset is present by the second end face 337*b* being closer to the planar connecting base 333 and its plane Y-Y.

Whilst the modification to the casing and to the poles is shown with reference to a three tooth electromagnetic stirrer, the same principles can be applied to a two stirrer or a stirrer with more than three poles.

In the above illustrations, the invention has been shown with reference to a curved container wall, however, other non-planar container walls can be accommodated by the principle of the invention.

When considering the alignment of the end faces relative to each other and/or the connecting base at its plane, it can be beneficial to consider that alignment in the context of a tooth end face plane. The tooth end face plane can be established by the approach shown in FIGS. 7*a* and 7*b*. FIG. 7*a* shows a plan view of the tooth looking down the axis of the tooth. FIG. 7*b* shows a side view of the tooth, a view taken perpendicular to the view in FIG. 7*b*. The axis of the tooth T-T is perpendicular to the plane of the connecting base Y-Y in this instance. If any three points are selected on the edge of the tooth end face, points $A_1$, $A_2$, $A_3$ in FIG. 7*a*, then it is possible to define a plane upon which all three points $A_1$, $A_2$, $A_3$ lie and consider this to be the tooth end face plane, TEFP in FIG. 7*b*. Any three points can be selected, for instance $B_1$, $B_2$, $B_3$ and a plane defined. In many configurations of the tooth end face the tooth end face plane defined by any set of three points will be the same or substantially the same. Two tooth end planes are not aligned when they are angled relative to one another, such as is the case in FIG. 3 and FIG. 4 or when they are in parallel but off set planes, as is the case in FIG. 6.

FIG. 8 is another detailed, plan view of an embodiment of the invention. The end face 137*a* for the first tooth 105, end face 137*b* for the second tooth 113 and end face 137*c* for the third tooth 117 are arranged such that the end faces lie on positions approaching the common arc A-A (seen in FIG. 3) which is concentric to the common arc B-B followed by the perimeter wall of the container (not shown but consistent with the FIG. 3 approach). The casing 133 is present and is formed of a series of angled panels to also generally accommodate an arcuate profile for the container (not shown). In this case the end faces 137*a, b, c* are planar.

The invention claimed is:

1. Apparatus for stirring a molten metal, the apparatus comprising:

an electromagnetic stirrer including a core having a base, a plurality of teeth, and a plurality of electrically conducting coils; and connections for applying a current to the electrically conducting coils;

wherein the plurality of teeth each have a proximal end and a distal end that is further from the base than the proximal end, each distal end defining a tooth end face;

wherein the plurality of teeth includes a first tooth and a second tooth;

the tooth end face for the first tooth is not parallel to the second tooth;

a length of the second tooth is greater than a length of the first tooth; and the plurality of teeth include a third tooth, and the tooth end face of the third tooth is not parallel to the tooth end face of the first or second teeth.

2. Apparatus according to claim 1, wherein the apparatus comprises one or more features selected from the list of features consisting of:

1) one or more tooth end faces are inclined at an angle relative to one or more other tooth end faces;

2) one or more tooth end faces are inclined at an angle relative to a face of the base which connects the plurality of teeth together;

3) one or more tooth end faces are inclined at an angle relative to one or more other tooth end faces and one or more tooth end faces are parallel to a face of the base;

4) one or more tooth end faces are parallel to, but not coplanar with, one or more other tooth end faces;

5) one or more tooth end faces are parallel to, but not coplanar with, one or more other tooth end faces and are parallel to, but not coplanar with, a face of the base; and 6) one or more of the tooth end faces are nonplanar.

3. Apparatus according to claim 1, wherein each of the plurality of electrically conducting coils are wrapped around a respective one of the plurality of teeth.

4. Apparatus according to claim 1, wherein the plurality of teeth extend perpendicular to the base.

5. Apparatus according to claim 4, wherein the third tooth is an outermost tooth on one side of the plurality of teeth and includes a length that is greater than the length of the first tooth.

6. Apparatus according to claim 5, wherein the second tooth is an outermost tooth on another side of the plurality of teeth, the length of the second tooth is the same as the length of the third tooth.

7. Apparatus according to claim 5, wherein:

the first tooth is a middle, innermost tooth of the plurality of teeth; and the length of the first tooth is less than the length of the third tooth.

8. Apparatus according to claim 7, wherein at least one tooth of the plurality of teeth:

has a length that is between the length of the third tooth and the length of the second tooth, and is physically disposed between the first tooth and the third tooth.

9. Apparatus according to claim 1, wherein the tooth end faces are provided such that an air gap between one or more tooth end faces and an outer wall of a container for the molten metal is less than 10 cm.

10. Apparatus according to claim 9, wherein the air gap is less than 5 cm.

11. Apparatus according to claim 1, wherein the plurality of teeth are shaped such that a distance between each of the tooth end faces and an outer wall of a container in which the apparatus is configured to stir molten metal is substantially equal.

12. Apparatus according to claim 11, wherein the distance between each of the tooth end faces and an outer wall of a container is less than 10 cm.

13. Apparatus according to claim 1, wherein one or more of the tooth end faces is configured to match a shape of at least a portion of a non-planar container in which the apparatus is configured to stir molten metal, and the apparatus comprises one or more features selected from the list of features consisting of:

a) a location on the tooth end face for two or more of the tooth end faces lies on a common arc;

b) a location on the tooth end face for two or more of the tooth end faces lies on a common arc and that common arc is concentric with the arc defined by at least the opposing part of the container;

c) an equivalent location on the tooth end face for two or more of the tooth end faces lies on a common arc;

d) an equivalent location on the tooth end face for two or more of the tooth end faces lies on a common arc and that common arc is concentric with the arc defined by at least the opposing part of the container;

e) the center of the tooth end face for two or more of the tooth end faces lies on a common arc; and f) the center of the tooth end face for two or more of the tooth end faces lies on a common arc and that common arc is concentric with the arc defined by at least the opposing part of the container.

14. Apparatus according to claim 1, wherein the apparatus further comprises one or more features selected from the list of features consisting of:

a casing for the apparatus;

a support frame;

one or more cooling spaces;

a control system; or a combination thereof.

15. A method of stirring molten metal within a container, the method including:

applying a current to a first electrically conducting coil coupled to a first tooth of an electromagnetic stirrer at a first time to generate a first magnetic field configuration; and applying a current to a second electrically conducting coil coupled to a second tooth of the electromagnetic stirrer at a second time to generate a second magnetic field configuration, such that the changes in magnetic field configuration cause movement of the molten metal within the container;

wherein the first and second teeth extend from a base and each have a proximal end and a distal end that is further from the base than the proximal end, each distal end defining a tooth end face that is curved; and wherein a length of the first tooth is greater than a length of the second tooth.

16. Apparatus for stirring a molten metal, the apparatus comprising:

an electromagnetic stirrer including a core having a base, a plurality of teeth, and a plurality of electrically conducting coils; and connections for applying a current to the electrically conducting coils;

wherein the plurality of teeth each have a proximal end and a distal end that is further from the base than the proximal end, each distal end defining a tooth end face;

wherein:

the plurality of teeth includes a first tooth and a second tooth;

the tooth end face for the first tooth is not parallel to the second tooth;

the tooth end faces of the plurality of teeth are curved; and a radius of curvature of the tooth end faces is substantially equal to a radius of curvature of a container surface configured to hold molten metal.

17. Apparatus for stirring a molten metal, the apparatus comprising:

an electromagnetic stirrer including a core having a base, a plurality of teeth, and a plurality of electrically conducting coils; and connections for applying a current to the electrically conducting coils;

wherein the plurality of teeth each have a proximal end and a distal end that is further from the base than the proximal end, each distal end defining a tooth end face; and wherein:

the plurality of teeth includes a first tooth and a second tooth;

the tooth end face for the first tooth is not parallel to the second tooth;

a length of the second tooth is greater than a length of the first tooth; and the tooth end faces are provided such that an air gap between one or more tooth end faces and an outer wall of a container for the molten metal is less than 10 cm.

* * * * *